US010694787B2

(12) United States Patent
Crespo

(10) Patent No.: US 10,694,787 B2
(45) Date of Patent: Jun. 30, 2020

(54) HANDHELD VAPORIZING DEVICE WITH ROTATING LIQUID HOUSING CHAMBER

(71) Applicant: GYRE VAPES LLC, Coconut Creek, FL (US)

(72) Inventor: Fernando Hiram Crespo, Coconut Creek, FL (US)

(73) Assignee: GYRE VAPES LLC, Coconut Creek, FL (US)

( * ) Notice: Subject to any disclaimer, the term of this patent is extended or adjusted under 35 U.S.C. 154(b) by 0 days.

(21) Appl. No.: 16/583,253

(22) Filed: Sep. 25, 2019

(65) Prior Publication Data

US 2020/0093184 A1 Mar. 26, 2020

Related U.S. Application Data

(60) Provisional application No. 62/735,976, filed on Sep. 25, 2018.

(51) Int. Cl.

| | |
|---|---|
| ***A24F 47/00*** | (2020.01) |
| ***H05B 1/02*** | (2006.01) |
| ***A24F 7/02*** | (2006.01) |

(52) U.S. Cl.

CPC ..... *A24F 47/008* (2013.01); *A24F 7/02* (2013.01); *H05B 1/0297* (2013.01)

(58) Field of Classification Search

CPC ..... A24F 47/008

See application file for complete search history.

(56) References Cited

U.S. PATENT DOCUMENTS

| | | | | |
|---|---|---|---|---|
| 4,171,703 | A | 10/1979 | Locke | |
| 4,183,365 | A | 1/1980 | Kelley | |
| 9,179,710 | B2 | 11/2015 | Chaoui | |
| 9,498,002 | B1 | 11/2016 | Soreide | |
| 2001/0039953 | A1 | 11/2001 | McCoy | |
| 2010/0326453 | A1 | 12/2010 | Chaoui | |
| 2015/0125136 | A1 | 5/2015 | Sanchez | |
| 2015/0223522 | A1* | 8/2015 | Ampolini | A61M 11/042 131/328 |
| 2016/0007654 | A1* | 1/2016 | Zhu | A24F 47/008 131/328 |

(Continued)

*Primary Examiner* — James Harvey

(74) *Attorney, Agent, or Firm* — Mark C. Johnson; Johnson Dalal

(57) ABSTRACT

A handheld vaporizing device with rotating liquid housing chamber provides a multi-functional, handheld vaporizer/e-cigarette used to extract the active ingredients of a liquid substance for inhalation. The device provides a mouthpiece and a colinear rotatable multi-chamber housing. The housing has three enclosed chambers that receive individual liquid capsules filled with a liquid substance for smoking. Each enclosed chamber has one of a plurality of heating element assemblies, and a corresponding liquid capsule. Rotation of the housing to a locked position aligns a liquid capsule with a heating element assembly to achieve the vaporization of the contained liquid substance. An illumination subassembly lights up to indicate operation of heating element assemblies, charging capacity and status, and for providing an ornamental effect. A wax subassembly, which is interchangeable with the illumination subassembly, attaches colinear to the handle of the device for storing, manipulating, and heating a vapor wax used for inhalation.

20 Claims, 5 Drawing Sheets

(56) References Cited

U.S. PATENT DOCUMENTS

| | | | | |
|---|---|---|---|---|
| 2016/0143352 | A1 | 5/2016 | Bavar | |
| 2016/0211693 | A1* | 7/2016 | Stevens | H05B 1/0244 |
| 2017/0071255 | A1* | 3/2017 | Revell | H05B 1/0244 |

* cited by examiner

HANDHELD VAPORIZING DEVICE WITH ROTATING LIQUID HOUSING CHAMBER

CROSS-REFERENCE TO RELATED APPLICATION

This application claims priority to U.S. Provisional Patent Application No. 62/735,976 filed Sep. 25, 2018, the entirety of which is incorporated by reference.

FIELD OF THE INVENTION

The present invention relates generally to a handheld vaporizing device with rotating liquid housing chamber, and, more particularly, relates to a vaporizing device shaped as a vaporizer pen having a rotatable multi-chamber housing with a several individual chambers for holding a variety of different liquid substances and vaping products, such as liquid, wax or herbal products.

BACKGROUND OF THE INVENTION

Vaporizing pens or pipes, also known as vapes, are well known in the art. Vapes typically include one chamber for holding a smoking article, such as liquid, wax or herbal products, generally referenced herein as smoking products. The smoking products may come in many different flavors. The problem is that a vaping person may wish to change the flavor or substance of the smoking product being smoked and must clean out the vaporizer device before adding new product. This may also occur when one is sharing the vaporizer device with another person.

Multi-chamber hookahs having multiple hoses are known but they are large and bulky and do not include a portable vaporizer device with multi-chamber revolver. A multi-chamber vaporizer device with chambers on a track assembly is also known but it does not include a convenient revolver assembly with multiple chambers having their own heating coil and is complicated in design and construction and prone to breaking. The known smoking devices fail to disclose a vaporizing device having a revolver with multiple chambers that is rotatable for selectively positioning a chamber housing the desired smoking product over a power source for energizing the chamber coil to heat the product for smoking.

It is therefore desirable to have a vaporizer device with multiple chambers in a revolver assembly with individual coils in each chamber and a single power platform for selectively energizing a desired chamber coil. If there existed such a device it would address the shortcomings in the background art and be well received. As there are no such device known, there exists a need for such a device. It is, therefore, to the effective resolution of the aforementioned problems and shortcomings of the prior art that the present invention is directed. The instant invention addresses this unfulfilled need in the prior art by providing a vaporizer revolver device with multiple chambers as contemplated by the instant invention disclosed.

Therefore, a need exists to overcome the problems with the prior art as discussed above.

SUMMARY OF THE INVENTION

The invention provides a handheld vaporizing device with rotating liquid/vaporizing housing chamber that overcomes the hereinafore-mentioned disadvantages of the heretofore-known devices and methods of this general type and that provides a multi-functional, handheld vaporizer/e-cigarette used to extract the active ingredients of a liquid substance, plant material, or other herbs for inhalation; and having multiple loading chambers into which a plurality of liquid substances, i.e., e-cigarette liquid, vapor wax, may be loaded for selectively vaporizing one of the plurality of liquid substances through a simple rotation of a multi-chambered liquid housing With the foregoing and other objects in view, there is provided, in accordance with the invention, a handheld vaporizing device with rotating liquid housing chamber provides a multi-functional, handheld e-cigarette/vaporizer that utilizes multiple loading chambers into which a plurality of liquid substances, i.e., e-cigarette liquid, vapor wax, may be loaded for selectively vaporizing one of the plurality of liquid substances through one-handed rotation of a multi-chambered liquid housing.

The device also provides multiple unique features that enhance the vaporization experience, such as selective vaporization through a simple rotation along a chamber rotation path that can be locked into a desired liquid capsule for vaporization. The device also provides a light emitting diode (LED) illumination subassembly that lights up to indicate operation of heating element assemblies, charging capacity and status, and for providing an ornamental effect to the device. Further, the device provides a wax subassembly that is interchangeable with the illumination subassembly at the end of the elongated handle member. The wax subassembly attaches colinear to the handle for storing, manipulating, and heating a vapor wax used for inhalation.

a wax subassembly that is interchangeably attached to the device with the illumination subassembly for storing, manipulating, and heating a vapor wax used with other substances for inhalation.

In some embodiments, the device may include a mouthpiece that is defined by an inner threaded sidewall defining a center aperture defined thereon. The device also includes a multi-chambered liquid housing having a lower end and an upper end opposing the lower end and directly coupled to the mouthpiece. In other embodiments, a chamber length separates the lower and upper ends of the housing. The chamber length has a center enclosed channel that spans the chamber length, and has an axle disposed therein. The axle is defined by a bottom end and a top end, with the top end of the axle threadedly coupled to the inner threaded sidewall.

In other embodiments, the housing defines a plurality of enclosed chambers spanning the chamber length. Each enclosed chamber has one of a plurality of heating element assemblies and a liquid capsule sized and dimensioned to contain a liquid substance, disposed therein. The plurality of heating element assemblies each have a conductive heating member. The heating element assemblies are in thermal communication with the liquid capsules.

In yet other embodiments, the device provides an elongated handheld handle member used to both, grip the device, and contain the powering, heating, and illuminating components. The handheld handle member has a first end and a second end opposing the first end. The second end is directly coupled to the bottom end of the axle. The second end 108 includes the axle extending outwardly away therefrom.

The second end also includes a main conductive heating member disposed thereon. The main conductive heating member is operably configured to generate heat. The main conductive heating member is in thermal communication, and electrically and directly coupled with the heating element assemblies. The heat generated by the main conductive heating member transfers to the heating element assemblies and the liquid capsules.

In some embodiments, the multi-chambered liquid housing is configured to rotate about the axle and with respect to the handheld handle member and the mouthpiece. Further, the multi-chambered liquid housing can move to a locked position along a chamber rotation path with the conductive heating member of only one of the plurality of heating element assemblies. When in such a locked position, the liquid capsule in communication with the heating element assembly vaporizes the liquid substance contained therein. In this manner, the liquid substance contained in one of the liquid capsules vaporizes while in thermal communication with a corresponding heating element assembly in the locked position.

In accordance with another feature, an embodiment of the present invention includes a substantially rigid rounded notch disposed at the second end, the rounded notch shaped and sized to be received within a notch recess defined on the lower end of the multi-chambered liquid housing and resisting rotational movement of the multi-chambered liquid housing when in the locked position in the chamber rotation path.

In accordance with a further feature of the present invention, the lower end of the multi-chambered liquid housing is defined by three notches, and the lower end of the multi-chambered liquid housing is defined by three corresponding notch recesses.

In accordance with a further feature of the present invention, the liquid capsules are in alignment with the heating element assemblies in the locked position.

In accordance with a further feature of the present invention, the liquid capsules slidably receive the heating element assemblies.

In accordance with another feature, an embodiment of the present invention also includes a power source.

In accordance with a further feature of the present invention, the main conductive heating member is electrically coupled to the power source.

In accordance with yet another feature, an embodiment of the present invention includes a switch electrically and directly coupled with the power source, the switch further being directly coupled to the multi-chambered liquid housing.

In accordance with a further feature of the present invention, the switch is operably configured to actuate a current from the power source to the main conductive heating member, and the switch is operably configured to release the multi-chambered liquid housing from the locked position.

In accordance with a further feature of the present invention, the device further includes a heating element and multiple heating coils electrically coupled to the main conductive heating member.

In accordance with a further feature of the present invention, the mouthpiece comprises a power connection plate attachable to the upper end of the housing in a snap-fit relationship.

In accordance with a further feature of the present invention, the device may also include an illumination subassembly joined to the first end of the handheld handle member. The illumination subassembly is configured to illuminate when the liquid substance contained in one of the liquid capsules vaporizes.

In accordance with a further feature of the present invention, the illumination subassembly comprising an at least partially transparent light plate, a light housing, an LED diode, an LED printed circuit board, a capsule body, and a capsule cap joined to the first end of the handheld handle member.

In accordance with a further feature of the present invention, and interchangeable with the illumination subassembly, a wax subassembly joins to the first end of the handheld handle member. The wax subassembly comprises a wax capsule sized and dimensioned to contain a wax or dry herb.

In accordance with a further feature of the present invention, for use in conjunction with the was subassembly, a magnetic wax tool detachably attaches to the handheld handle member, the magnetic wax tool is operable as a tool to grab or handle wax or other vaporizing substance inside the chamber without getting the user's hand(s) dirty.

In accordance with a further feature of the present invention, the second end of the handheld handle member is defined by an airflow opening.

In accordance with a further feature of the present invention, the housing comprises a window.

In accordance with a further feature of the present invention, the device may recharge through use of a USB cable and a USB port disposed in the handheld handle member.

Although the invention is illustrated and described herein as embodied in a handheld vaporizing device with rotating liquid housing chamber, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the handheld handle member. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 9A shows a front view, and FIG. 9B shows a rear view, in accordance with the principles of the present invention;

DETAILED DESCRIPTION

Figure 1:
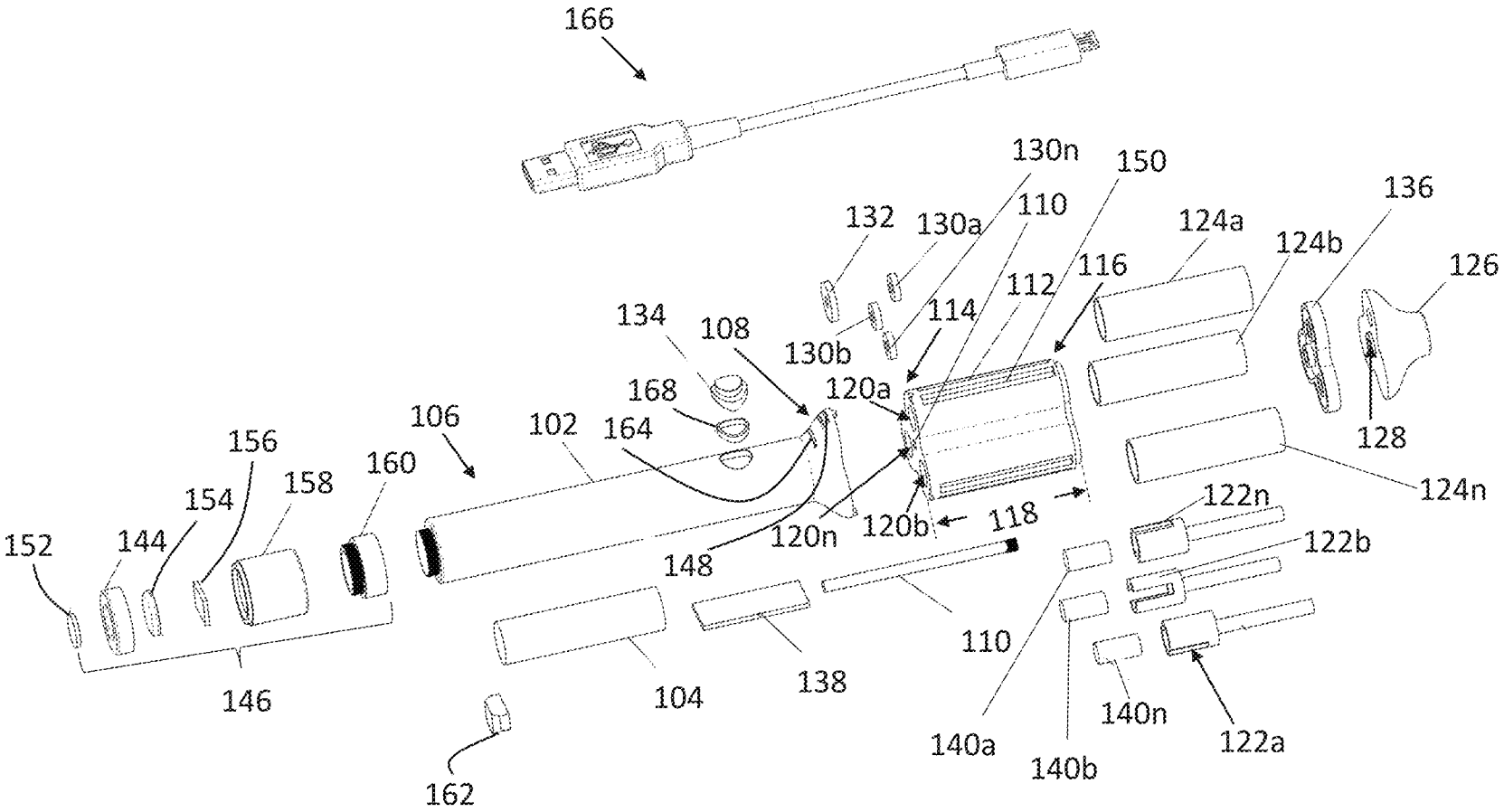
FIG. 1 provides an exploded view of the multi-chamber vaporizer device, in accordance with the principles of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient handheld vaporizing device with rotating liquid housing chamber. Embodiments of the invention provide a vaporizer in the form of a pipe or pen with a rotating multi-chambered liquid housing having multiple chambers for holding and smoking a plurality of different liquid, wax or herbal smoking products, generally referenced herein as smoking products. In addition, embodiments of the invention provide that the enclosed chambers each have their own heating coil or heating element that is positioned over a power source or platform when the housing is rotated to place the chamber with the desired smoking product over the power source. This energizes the heating coil in the corresponding chamber so as to heat the smoking product to a temperature that facilitates smoking.

Referring now to FIG. 1, one embodiment of the present invention is shown in a blow-up view. FIG. 1 shows several advantageous features of the present invention, but, as will be described below, the invention can be provided in several shapes, sizes, combinations of features and components, and varying numbers and functions of the components. The first example of a handheld vaporizing device with rotating liquid housing chamber, as shown in FIG. 1, includes a multi-functional, handheld vaporizer/e-cigarette used to extract the active ingredients of a vaporizing substance, e.g., a liquid substance, a plant material, or other smoking herb for inhalation. The device has multiple loading chambers into which a plurality of liquid substances, i.e., e-cigarette liquid, vapor wax, may be loaded for selectively vaporizing one of the plurality of liquid substances through one-handed rotation of a multi-chambered liquid housing.

In another embodiment, the device 100 also provides multiple unique features that enhance the vaporization experience, such as selective vaporization through a simple rotation along a chamber rotation path that can be locked into a desired liquid capsule for vaporization. The device also provides a light emitting diode (LED) illumination subassembly that lights up to indicate operation of heating element assemblies, charging capacity and status, and for providing an ornamental effect to the device. Further, the device provides a wax subassembly 1000 that is interchangeably attachable with the illumination subassembly 146 to the handle member 102 for storing, manipulating, and heating a vapor wax used with other substances for inhalation.

As FIG. 1 references, the device comprises a mouthpiece 126 sized and dimensioned to receive a mouth for inhaling the liquid substance. The mouthpiece has a tapered, or mushroom shape that has an inner threaded sidewall 302 defining a center aperture 128. The center aperture provides a passageway for smoke and flavored substance to flow to and from the mouth. In some embodiments, the mouthpiece 126 comprises a power connection plate 136 attachable to the upper end 116 of the housing 112 in a snap-fit relationship. The power connection plate 136 is in a fixed position to line up with only one chamber 120*a-n* at a time depending on which chamber 120*a-n* is positioned over the power connection plate 136. The power connection plate 136 is in electrical communication with a power source inside the elongated handheld handle member 102, discussed below.

Figure 2:
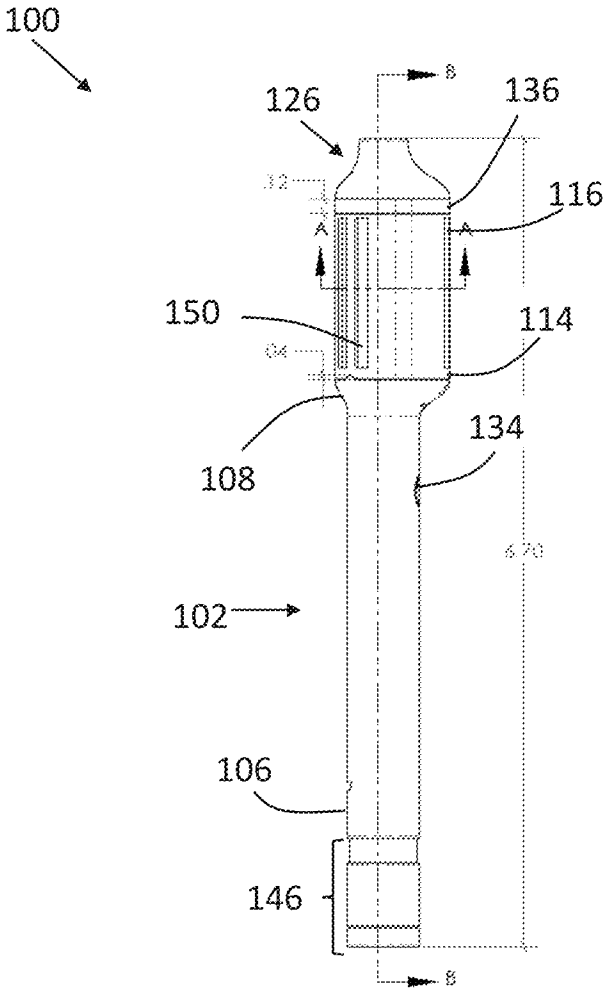
FIG. 2 is an elevated side view of the multi-chamber revolver of the vaporizer device shown in FIG. 1, in accordance with the principles of the present invention.

The device 100 also includes a multi-chambered liquid housing 112 that is rotatable, and used to contain the capsules for the liquid substance. The housing 112 is directly coupled to the mouthpiece 126, lying in a colinear relationship. This is illustrated in FIG. 2, which shows an elevated side view of the multi-chamber revolver of the vaporizer device 100. Furthermore, the housing has a lower end 114 and an upper end 116 opposing the lower end 114. In one non-limiting embodiment, the housing 112 is cylindrical, and about 1.24" long.

Figure 3:
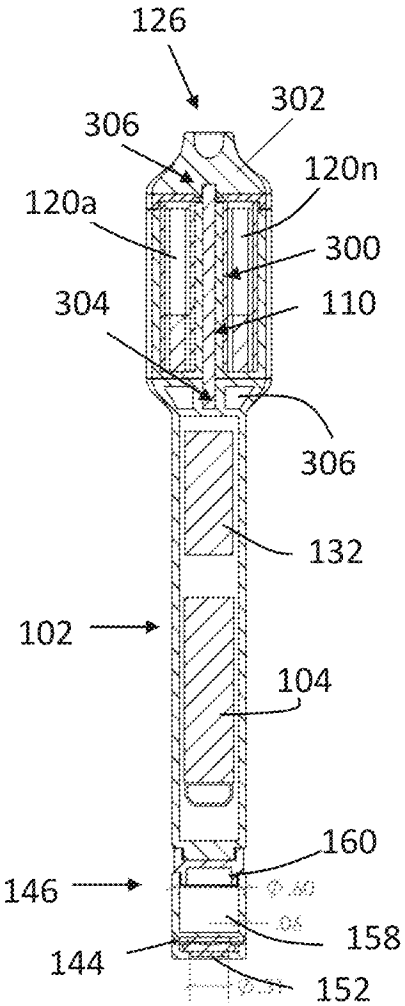
FIG. 3 is a sectioned side view of the smoking product storage capsule of the vaporizer device shown in FIG. 1, in accordance with the principles of the present invention.

In other embodiments, a chamber length 118 separates the lower and upper ends 114, 116 of the housing. The chamber length has a center enclosed channel 300 that spans the chamber length 118, and has an axle 110 disposed therein. FIG. 3 shows a sectioned view of the device, with the center enclosed channel 300 illustrated for easy identification. The channel 300 is sized and dimensioned to carry vapors, smoke, and debris on the mouthpiece 126, and an airflow 148, discussed below. The axle 110 is defined by a bottom end 304 and a top end 306, with the top end 306 of the axle 110 threadedly coupled to the inner threaded sidewall 302. The axle 110 concentrically passes through the channel, enabling rotation of the housing and chambers therein.

Figure 4:
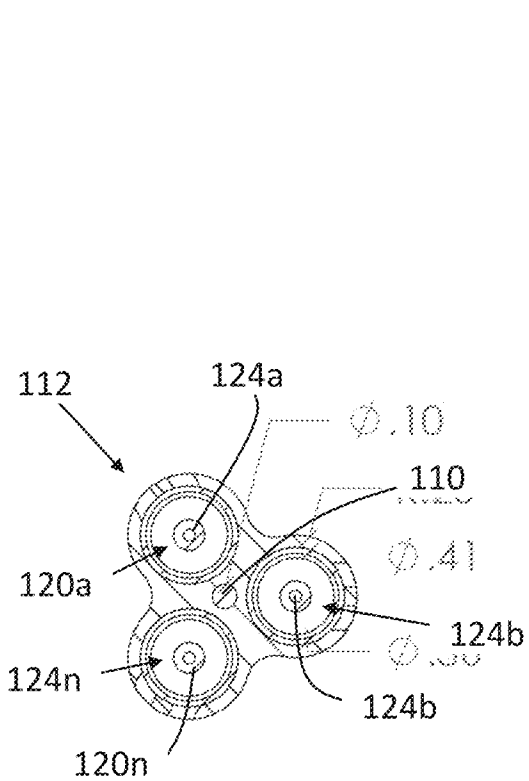
FIG. 4 provides a top view of an exemplary multi-chamber rotating housing, in accordance with the principles of the present invention.

As illustrated in top view of FIG. 4, the multi-chamber housing 112 defines a plurality of enclosed chambers 120*a-n* spanning the chamber length 118 and being generally equidistant from each other. In one embodiment, the enclosed changers have an elongated cylindrical shape. Each enclosed chamber 120*a*, 120*b*, 120*n* has one of a plurality of heating element assemblies 122*a-n*, and a liquid capsule 124*a-n* sized and dimensioned to contain a liquid substance, disposed therein. The heating element assemblies 122*a-n* and the liquid capsules 124*a-n* work together to selectively vaporize a desired liquid solution contained in one of the liquid capsules 124*a*.

Each enclosed chamber 120*a-n* has an aperture that is brought into selective alignment or registry with the heating element and central channel 300, such that smoke is generated by the heating of the liquid substance with the heating element is drawn through the central channel toward the mouthpiece when a suction force is exerted on the mouthpiece 126. Rotation of the housing 112 to a locked position 604 aligns a liquid capsule with a corresponding heating element assembly to achieve the vaporization of the liquid substance contained therein.

In one non-limiting embodiment, the liquid capsule 124*a-n* has a generally elongated cylindrical shape, containing a liquid substance known in the art of vaping. This may include different flavors of liquid substances, i.e., apple, mint, etc. In one embodiment, the liquid capsule 124*a-n* forms a seal with the enclosed chambers 120*a-n*, so as to prevent moisture and debris from contaminating the liquid solution therein. In another embodiment, the housing comprises a window 150 and the liquid capsule 124*a-n* is transparent, so as to enable visual inspection of the type and quantity of liquid substance contained therein.

The plurality of heating element assemblies 122*a*, 122*b*, 122*n* each have a conductive heating member 130*a-n* that generates sufficient heat for vaporizing the liquid substance when put in alignment therewith. The heating element assemblies 122*a-n* are in thermal communication with the liquid capsules 124*a-n*. In one embodiment, the liquid capsules 124*a-n* slidably receive the heating element assemblies 122*a-n*, such that each heating element assembly 124*a*, 124*b*, 124*n* has a corresponding liquid capsule 124*a*, 124*b*, 124*n*. In one non-limiting embodiment, three heating element assemblies and three liquid capsules are used. However, in alternative embodiments, more than three may be used.

Figures 5, 6, 7:
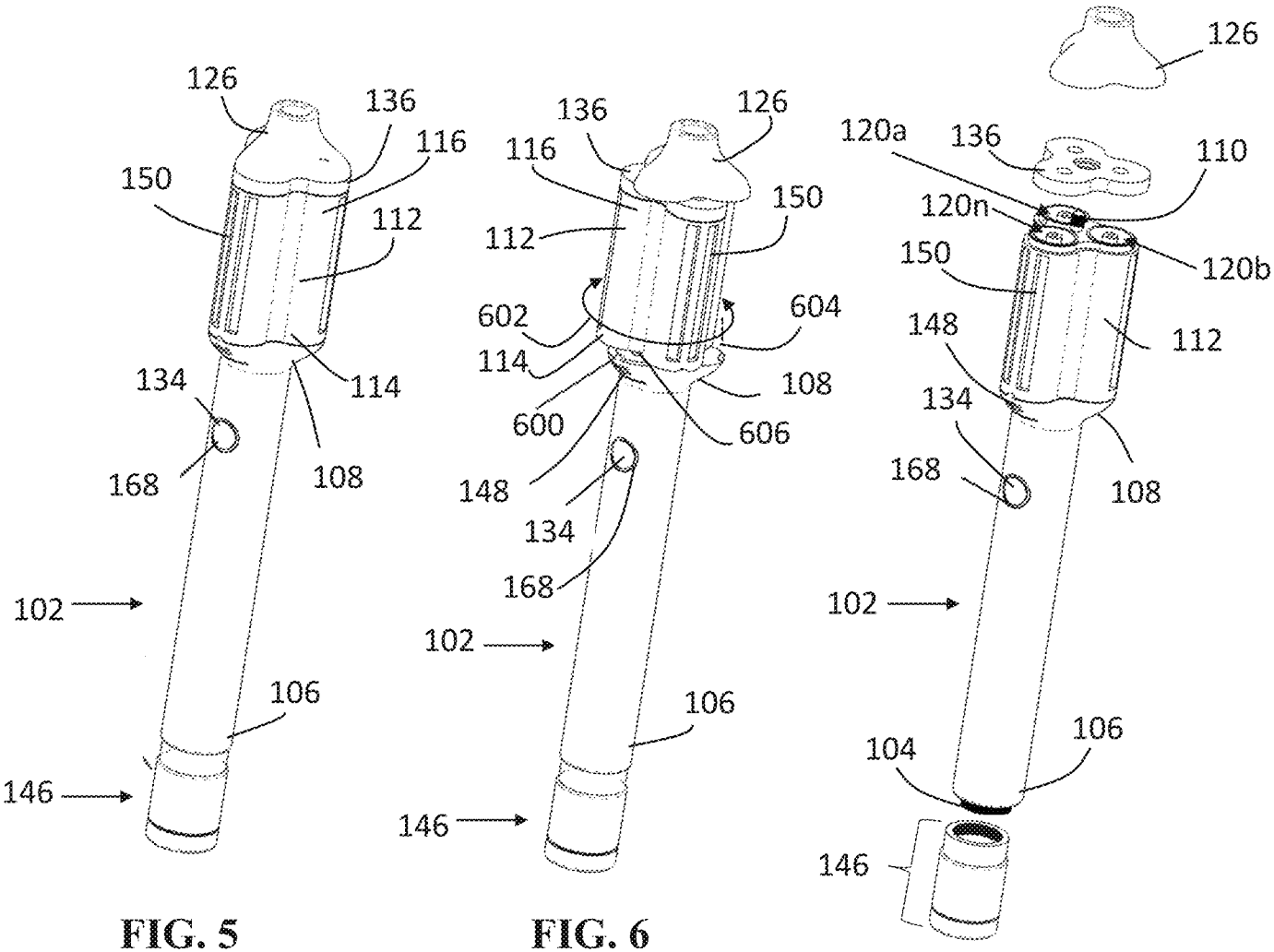
FIG. 5 provides a perspective view of the multi-chamber vaporizer device, showing the mouthpiece, multi-chamber housing, and handle member attached colinearly for operation, in accordance with the principles of the present invention.
FIG. 6 provides a perspective view of the multi-chamber vaporizer device, showing the multi-chamber housing rotating about a rotational path about the axle, in accordance with the principles of the present invention.
FIG. 7 provides a perspective view of the multi-chamber vaporizer device, showing the mouthpiece and the illumination subassembly detached from the multi-chamber housing and the handle member, respectively, in accordance with the principles of the present invention.

In yet other embodiments, the device 100 provides an elongated handheld handle member 102 that is utilized to both, grip the device 100, and contain the powering, heating, and illuminating components thereof. In one non-limiting embodiment, the handle member 102 is elongated, cylindrical, and about 3.5" long. The handheld handle member 102 has a first end 106 and a second end 108 opposing the first end 106. The second end 108 is directly coupled to the bottom end 304 of the axle 110. The second end 108 includes the axle 110 extending outwardly away therefrom. FIG. 7 provides a perspective view of the device 100, showing the mouthpiece 126 and the illumination subassembly 146 detached from the multi-chamber housing and the handle member, respectively.

In one non-limiting embodiment, the second end 108 of the handheld handle member 102 is defined by an airflow opening 148. The airflow opening 148 is in communication with the center channel 300, heating element assembly 124*a-n*, liquid capsules 124*a-n*, and other components that are vaporized, or carry residue from the vaporization process. Adjacent to the airflow opening 148, a liquid substance indicator light 164 is provided. The liquid substance indicator light 164 is in operational communication with the liquid capsule 124*a-n* and the illumination subassembly 146, described below. The liquid substance indicator light 164 operably configured to illuminate when the liquid substance is depleted from the liquid capsule to a predetermined amount.

The second end 108 of the handheld handle member 102 also includes a main conductive heating member 132 disposed thereon. The main conductive heating member 132 is operably configured to generate heat. In one non-limiting embodiment, the main conductive heating member 132 is an atomizer. The main conductive heating member 132 is in thermal communication, and electrically and directly coupled with the heating element assemblies 122*a-n*. The heat generated by the main conductive heating member 132 transfers to the heating element assemblies 122*a-n* and the liquid capsules 124*a-n*.

Figure 8:
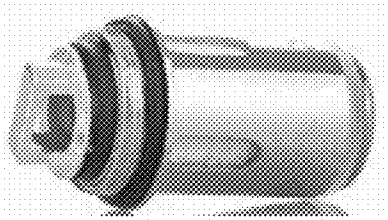
FIG. 8 provides a perspective view of an exemplary heating coil for the main heating element, in accordance with the principles of the present invention.

In accordance with being a vaping device, a heating element 142 and multiple heating coils 140*a-n* may be operably configured to electrically couple with the main conductive heating member 132. The heating coils, shown in FIG. 8, are automated to adjust temperature settings for optimal vaporization of the liquid substances. The achieved temperature can be controlled, and can range from 300° F.

to 600° F. The power sent to the heating coils 140*a-n* automatically adjusts to maintain the liquid substance at the optimal vaping temperature. In one embodiment, the vaporizing temperature may be selectively adjusted with an electronic display or buttons employed with the device.

In some embodiments, the device 100 provides a power source 104 for actuating the main conductive heating member 132 to generate heat. The main conductive heating member 132 is electrically coupled to the power source 104. In some embodiments, the power source 104 may include, without limitation, a rechargeable lithium-ion battery. As FIG. 1 illustrates, the device 100 may recharge the power source through use of a USB cable 166 and a USB port 162 disposed in the handheld handle member 102. The USB cable 166 may connect to an external power source from one end, and into the USB port from the opposite end. In one non-limiting embodiment, the USB port 162 is a micro USB port.

In some embodiments, the device 100 provides a switch 134 that is operational on the handheld handle member 102, and electrically and directly coupled with the power source. The switch 134 is operably configured to actuate a current from the power source to the main conductive heating member 132. As the liquid capsules 124*a-n* are rotated in alignment with the heating element assemblies 122*a-n*, separate liquid capsules heat up, depending on the alignment of the liquid capsules with the heating elements.

Turning now to the side view of FIG. 5, the switch 134 may include a button with an LED light ring 168 circumambulating the button. Thus, when the switch 134 is activated the power source 104 is electrically connected to the power connection plate 136, which energizes the coils of the main conductive heating member 132 in the chamber housing that is positioned over the power connection plate 136 to heat the liquid substance for vaporization.

As illustrates, the multi-chambered liquid housing 112 is configured to rotate about the axle 110 and FIG. 6 with respect to the handheld handle member 102 and the mouthpiece 126. The rotation follows a chamber rotation path 602. Further, the multi-chambered liquid housing 112 can move to a locked position 604 along a chamber rotation path 602 with the conductive heating member 130*a-n* of only one of the plurality of heating element assemblies 122*a-n*. When in such a locked position 604, the liquid capsule in communication with the heating element assembly 122*a-n* vaporizes the liquid substance contained therein. In this manner, the liquid substance contained in one of the liquid capsules 124*a-n* vaporizes while in thermal communication with a corresponding heating element assembly 122*a-n* in the locked position 604.

Turning now to FIG. 6, an embodiment of the present invention includes a substantially rigid rounded notch 600 disposed at the second end 108. The rounded notch 600 is shaped and sized to be received within a notch recess 606 defined on the lower end 114 of the multi-chambered liquid housing 112. Engagement between the notches 600 and the notch recess 606 creates the locked position 604, such that rotational movement of the multi-chambered liquid housing 112 is resisted.

The interaction of notches 600 and notch recesses 606 creates a compression connection point that works to stop rotation of the multi-chambered liquid housing 112. This creates the locked position in the chamber rotation path 602. In some embodiments, the lower end 114 of the multi-chambered liquid housing 112 is defined by three notches. And the lower end 114 of the multi-chambered liquid housing 112 is defined by three corresponding notch recesses 606.

The liquid capsules 124*a-n* are rotated in alignment with the heating element assemblies 122*a-n* in the locked position 604. In one embodiment, rotating the multi-chambered liquid housing 112 causes separate liquid capsules to heat up, depending on the alignment of the liquid capsules with the heating elements. As the liquid capsules 124*a-n* are rotated in alignment with the heating element assemblies 122*a-n*, separate liquid capsules heat up, depending on the alignment of the liquid capsules with the heating elements.

The switch 134 is also operational to lock and unlock the housing during rotation. In one exemplary use, the switch is directly coupled to the multi-chambered liquid housing 112. For example, the switch 134 is depressed/manipulated to cause the release of the multi-chambered liquid housing 112 from the locked position 604. This can be through a catch-lock mechanism, or a tensioned spring that couples to the housing 112 and switch 134. In this manner, when the switch 134 is depressed, the multi-chambered liquid housing 112 is released from the locked position 604. In one embodiment, the multi-chambered liquid housing 112 may be locked and unlocked by pressing the switch 134 a predetermined number of times, such as three, so the locked position 604 is not accidentally activated.

In some embodiments, the device 100 provides informative visual cues through use of an illumination subassembly 146 that lights up to indicate operation of heating element assemblies, charging capacity and status, and for providing an ornamental effect to the device 100. The illumination subassembly 146 may include an elongated subassembly that detachably attaches to the first end 106 of the handheld handle member 102. The illumination subassembly 146 is configured to illuminate when the liquid substance contained in one of the liquid capsules 124*a-n* vaporizes, and also to indicate a charging status for the power source.

Figures 9A, 9B:
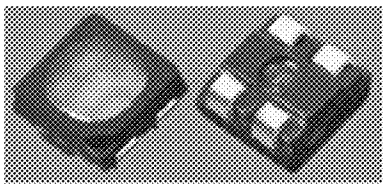
FIGS. 9A-9B provide a perspective view of an exemplary light emitting diode for the illumination subassembly, where

In one possible embodiment, the illumination subassembly 146 comprises a series of protective covering and electrical components aligned colinear with the handheld handle member 102. These lighting components include: an at least partially transparent light plate 152 disposed at the terminus for enabling passage of (and visibility) of light waves generated by LEDs; a light housing 144 to protect the LEDs; at least one LED diode 154, shown in FIGS. 9A-9B, for illuminating in at least one color and at least one lighting pattern; and an LED printed circuit board 156 for regulating intensity and light pattern of the diodes 154. The illumination from the LED diodes 154 shines through the terminus-position light plate 152, which may be completely transparent, translucent, or colored glass/plastic.

Additionally, the illumination subassembly 146 comprises a capsule body 158 that securely encapsulates the LED diode 154 and the LED printed circuit board 156; and a capsule cap 160, which may be threaded or have a snap-fit mechanism, to enable secure fastening means to the first end 106 of the handheld handle member 102. The cylindrical or rectangular shape of the capsule body 158 enables containment of the LED diode 154 and the LED printed circuit board 156, along with other powering components, such as the power source. In one embodiment, the capsule body 158 and the capsule cap 160 have substantially the same diameter and elongated cylindrical/rectangular shape as the handheld handle member 102.

Figure 10:
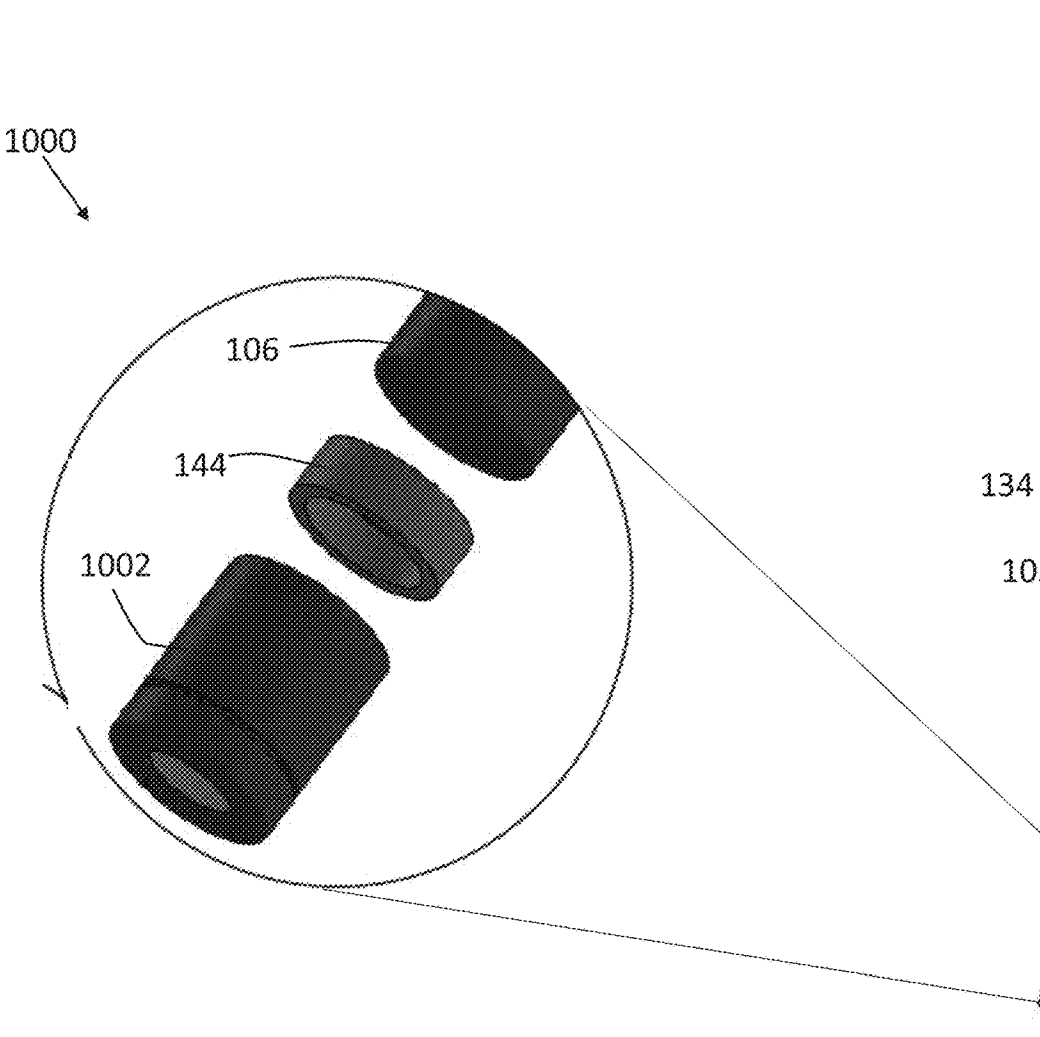
FIG. 10 provides a perspective view of the multi-chamber vaporizer device, showing a closeup of an exemplary wax capsule attached colinear to the handle member, in accordance with the principles of the present invention.

In accordance with a further feature of the present invention, and interchangeable with the illumination subassembly 146, the device 100 provides a unique reservoir and applicator for a vapor wax, such as a vapor-related wax or smoking substance known in the art of vaporizers. As shown in FIG. 10, a wax subassembly 1000 detachably joins, colinear, to the first end 106 of the handheld handle member 102. The wax subassembly 1000 comprises a wax capsule 1002 that is sized and dimensioned to contain a wax. The wax capsule 1002 may have the same diameter and elongated cylindrical/rectangular shape as the handheld handle member 102. In one embodiment, the attached end of the wax capsule 1002 forms a seal with the first end 106 of the handheld handle member 102, so as to prevent moisture and debris from contaminating the wax therein.

Figure 11:
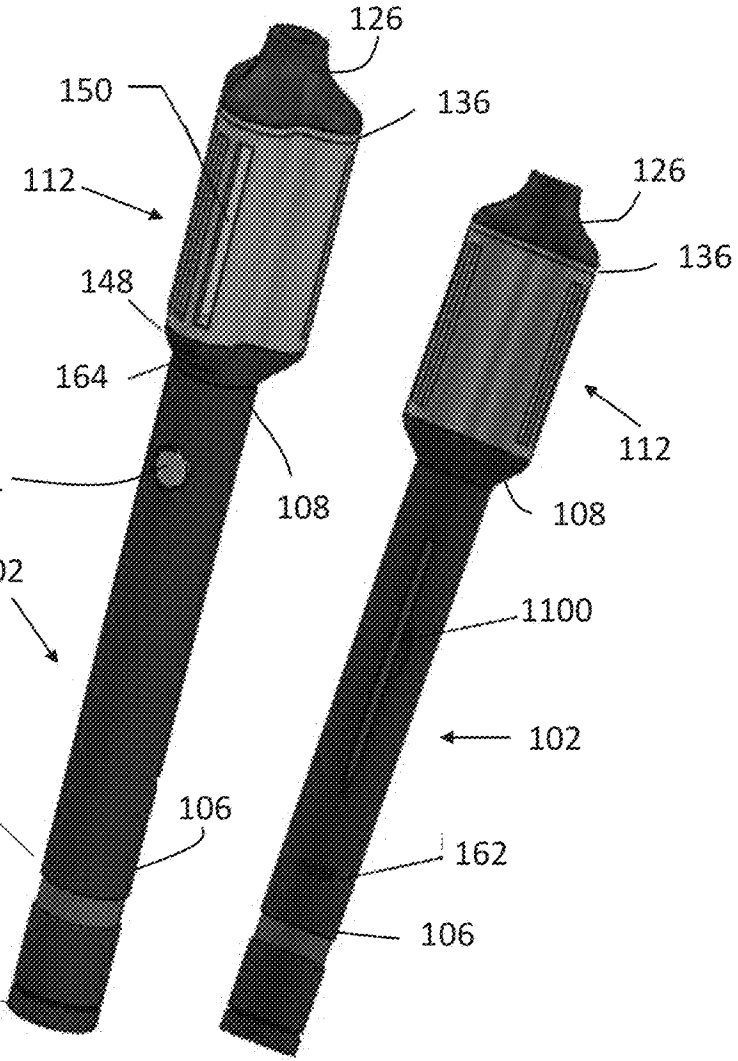
FIG. 11 provides a perspective view of the multi-chamber vaporizer device, showing an exemplary wax tool vaporizer attached to the wax capsule, in accordance with the principles of the present invention.

In accordance with a further feature of the device 100, for use in conjunction with the wax subassembly 1000, a wax tool 1100 detachably attaches or couples to the handheld handle member 102 (FIG. 11). The wax tool 1100 is operable to heat the wax inside the wax capsule 1002. The wax tool 1100 may include a magnetic wax pen that heats up to melt and apply the wax substance, as needed. In one non-limiting embodiment, the wax tool 1100 attaches longitudinally to the side of the wax subassembly 1000 and/or the handheld handle member 102. In one embodiment, the illumination subassembly 146 and the wax subassembly 1000 interchangeably attach to the first end 106 of the handheld handle member 102. In another embodiment, the illumination subassembly 146 and the wax subassembly 1000 attach end-to-end to each other, and colinear to the handheld handle member 102.

In operation, the liquid capsule 124*a-n* are loaded with multiple variants of a liquid substance used for smoking. The liquid capsules 124*a-n* are slidably loaded into a respective enclosed chamber 120*a-n*. The power supply is checked to make sure sufficient power is available. An illumination of a red color, for example, may indicate insufficient power. This requires charging through the USB cable 166, which couples to the USB port 162 disposed in the handheld handle member 102. For commencing the vaporization of liquid substances, the multi-chamber housing is rotated to the locked position to achieve the desired liquid substance. The switch 134 is then depressed in to power the coils of the main conductive heating member 132.

At this point, the power source powers the electrical functions, such as the heating coils, heating element, and illumination subassembly. A compression connection point at the top of the multi-chambered liquid housing 112 works to restrict rotation of the housing 112. The LED light ring 168 is illuminated when charging and when the power is activated. Thus, the user is aware when the vaporization is taking effect. If a wax is desired, the wax subassembly 1000 is detached, and the wax accessed with the wax tool 1100. The user may then proceed to inhale and suck on the mouthpiece 126, creating a smooth flow of smoke through the central channel 300 of the housing 112.

This is possible because each enclosed chamber 120*a-n* has an aperture that is brought into selective alignment or registry with a corresponding, aligned heating element assembly and the central channel 300, such that smoke is generated by the heating of the liquid substance. The heat generated by the main heating element is drawn through the central channel 300 toward the mouthpiece 126 when a suction force is exerted on the mouthpiece 126. Rotation of the housing 112 to a locked position 604 aligns a liquid capsule with a corresponding heating element assembly to achieve the vaporization of the liquid substance contained therein.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A handheld vaporizing device with rotating liquid housing chamber comprising:

a mouthpiece having an inner threaded sidewall defining a center aperture defined thereon;

a multi-chambered liquid housing having a lower end, an upper end opposing the lower end and directly coupled to the mouthpiece, a chamber length separating the lower and upper ends, defining a center enclosed channel spanning the chamber length and having an axle disposed therein and with a top end threadedly coupled to the inner threaded sidewall, and defining a plurality of enclosed chambers spanning the chamber length and each having one of a plurality of heating element assemblies and a liquid capsule, housing a vaporizing substance, disposed therein, the plurality of heating element assemblies each having a conductive heating member; and a handheld handle member coupled to a bottom end, opposing the top end, of the axle, housing a power source, and having a first end and a second end opposing the first end, the second end directly coupled to the lower end and including the axle extending outwardly away therefrom and including a main conductive heating member disposed thereon that is electrically coupled to the power source, the multi-chambered liquid housing operably configured to rotate about the axle and with respect to the handheld handle member and the mouthpiece and having a locked position in a chamber rotation path with the conductive heating member of only one of the plurality of heating element assemblies electrically and directly coupled to the main conductive heating member.

2. The handheld vaporizing device with rotating liquid housing chamber according to claim 1, wherein the handheld handle member further comprises:

a substantially rigid rounded notch disposed at the second end, the rounded notch shaped and sized to be received within a notch recess defined on the lower end of the multi-chambered liquid housing and resisting rotational movement of the multi-chambered liquid housing when in the locked position in the chamber rotation path.

3. The handheld vaporizing device with rotating liquid housing chamber according to claim 2, wherein the lower end of the multi-chambered liquid housing is defined by three notches, and the lower end of the multi-chambered liquid housing is defined by three notch recesses.

4. The handheld vaporizing device with rotating liquid housing chamber according to claim 1, wherein the liquid capsules are in alignment with the heating element assemblies in the locked position.

5. The handheld vaporizing device with rotating liquid housing chamber according to claim 1, wherein the liquid capsules slidably receive the heating element assemblies.

6. The handheld vaporizing device with rotating liquid housing chamber according to claim 1, further comprising a power source.

7. The handheld vaporizing device with rotating liquid housing chamber according to claim 6, wherein the main conductive heating member is electrically coupled to the power source.

8. The handheld vaporizing device with rotating liquid housing chamber according to claim 7, further comprising a switch electrically and directly coupled with the power source, the switch further being directly coupled to the multi-chambered liquid housing.

9. The handheld vaporizing device with rotating liquid housing chamber according to claim 8, wherein the switch is operably configured to actuate a current from the power source to the main conductive heating member, and the switch is operably configured to release the multi-chambered liquid housing from the locked position.

10. The handheld vaporizing device with rotating liquid housing chamber according to claim 1, further comprising a heating element and multiple heating coils electrically coupled to the main conductive heating member.

11. The handheld vaporizing device with rotating liquid housing chamber according to claim 1, wherein the mouthpiece comprises a power connection plate attachable to the upper end of the housing in a snap-fit relationship.

12. The handheld vaporizing device with rotating liquid housing chamber according to claim 1, further comprising an illumination subassembly joined to the first end of the handheld handle member, the illumination subassembly operably configured to illuminate when the vaporizing substance contained in one of the liquid capsules vaporizes.

13. The handheld vaporizing device with rotating liquid housing chamber according to claim 12, wherein the illumination subassembly comprising an at least partially transparent light plate, a light housing, an LED diode, an LED printed circuit board, a capsule body, and a capsule cap joined to the first end of the handheld handle member.

14. The handheld vaporizing device with rotating liquid housing chamber according to claim 1, further comprising a wax subassembly joined to the first end of the handheld handle member, the wax subassembly comprising a wax capsule sized and dimensioned to contain a wax.

15. The handheld vaporizing device with rotating liquid housing chamber according to claim 14, further comprising a magnetic wax tool detachably attached to the handheld handle member.

16. The handheld vaporizing device with rotating liquid housing chamber according to claim 1, wherein the second end of the handheld handle member is defined by an airflow opening.

17. The handheld vaporizing device with rotating liquid housing chamber according to claim 1, wherein the housing comprises a window.

18. The handheld vaporizing device with rotating liquid housing chamber according to claim 1, further comprising a USB cable and a USB port disposed in the handheld handle member.

19. A handheld vaporizing device with rotating liquid housing chamber comprising:

a mouthpiece having an inner threaded sidewall defining a center aperture defined thereon;

a multi-chambered liquid housing having a lower end and an upper end opposing the lower end and directly coupled to the mouthpiece, a chamber length separating the lower and upper ends of the housing, the chamber length defining a center enclosed channel spanning the chamber length and having an axle disposed therein and with a bottom end and a top end, the top end of the axle threadedly coupled to the inner threaded sidewall, the housing defining a plurality of enclosed chambers spanning the chamber length and each having one of a plurality of heating element assemblies and a liquid capsule sized and dimensioned to contain a liquid substance, disposed therein, the plurality of heating element assemblies each having a conductive heating member, the heating element assemblies being in thermal communication with the liquid capsules;

a handheld handle member having a first end and a second end opposing the first end, the second end defined by an airflow opening, the second end directly coupled to the bottom end of the axle, the second end including the axle extending outwardly away therefrom and including a main conductive heating member disposed thereon, the main conductive heating member operably configured to generate heat, the main conductive heating member being in thermal communication, and electrically and directly coupled with the heating element assemblies, whereby the heat generated by the main conductive heating member transfers to the heating element assemblies and the liquid capsules, the multi-chambered liquid housing operably configured to rotate about the axle and with respect to the handheld handle member and the mouthpiece, and having a locked position in a chamber rotation path with the conductive heating member of only one of the plurality of heating element assemblies, whereby the liquid substance contained in one of the liquid capsules vaporizes while in thermal communication with a corresponding heating element assembly in the locked position;

an illumination subassembly joined to the first end of the handheld handle member, the illumination subassembly operably configured to illuminate when the liquid substance contained in one of the liquid capsules vaporizes;

a power source electrically coupled to the main conductive heating member;

a switch electrically and directly coupled with the power source, the switch further being directly coupled to the multi-chambered liquid housing, the switch comprising an LED light ring; and a liquid substance indicator light in electrical communication with the illumination subassembly and the liquid capsules, the liquid substance indicator light operably configured to illuminate when the liquid substance is depleted to a predetermined amount.

20. A handheld vaporizing device with rotating liquid housing chamber comprising:

a mouthpiece having an inner threaded sidewall defining a center aperture defined thereon;

a multi-chambered liquid housing having a lower end and an upper end opposing the lower end and directly coupled to the mouthpiece, a chamber length separating the lower and upper ends of the housing, the chamber length defining a center enclosed channel spanning the chamber length and having an axle disposed therein and with a bottom end and a top end, the top end of the axle threadedly coupled to the inner threaded sidewall, the housing defining a plurality of enclosed chambers spanning the chamber length and each having one of a plurality of heating element assemblies and a liquid capsule sized and dimensioned to contain a liquid substance, disposed therein, the plurality of heating element assemblies each having a conductive heating member, the heating element assemblies being in thermal communication with the liquid capsules; and a handheld handle member having a first end and a second end opposing the first end, the second end defined by an airflow opening, the second end directly coupled to the bottom end of the axle, the second end including the axle extending outwardly away therefrom and including a main conductive heating member disposed thereon, the main conductive heating member operably configured to generate heat, the main conductive heating member being in thermal communication, and electrically and directly coupled with the heating element assemblies, whereby the heat generated by the main conductive heating member transfers to the heating element assemblies and the liquid capsules, the multi-chambered liquid housing operably configured to rotate about the axle and with respect to the handheld handle member and the mouthpiece, and having a locked position in a chamber rotation path with the conductive heating member of only one of the plurality of heating element assemblies, whereby the liquid substance contained in one of the liquid capsules vaporizes while in thermal communication with a corresponding heating element assembly in the locked position;

a wax subassembly joined to the first end of the handheld handle member, the wax subassembly;

a power source electrically coupled to the main conductive heating member; and a switch electrically and directly coupled with the power source, the switch being directly coupled to the power source.

* * * * *